United States Patent [19]

Culshaw et al.

[11] Patent Number: 4,966,724

[45] Date of Patent: Oct. 30, 1990

[54] VISCOUS HARD-SURFACE CLEANING COMPOSITIONS CONTAINING A BINARY GLYCOL ETHER SOLVENT SYSTEM

[75] Inventors: Stephen Culshaw, Le Pecq, France; Eddy Vos, Linden, Belgium

[73] Assignee: The Procter & Gamble Company, Cincinnati, Ohio

[21] Appl. No.: 303,411

[22] Filed: Jan. 27, 1989

[30] Foreign Application Priority Data

Jan. 30, 1988 [GB] United Kingdom ..... 8802106

[51] Int. Cl.[5] ..... C11D 3/44; C11D 3/20

[52] U.S. Cl. ..... 252/158; 252/171; 252/173; 252/174.14; 252/DIG. 14

[58] Field of Search ..... 252/162, 170, 171, 158

[56] References Cited

U.S. PATENT DOCUMENTS

| | | | |
|---|---|---|---|
| 3,591,510 | 7/1971 | Zenk | 252/137 |
| 3,882,038 | 5/1975 | Clayton et al. | 252/164 |
| 4,284,533 | 8/1981 | Imamura et al. | 252/542 |
| 4,614,606 | 9/1986 | Machin et al. | 252/116 |
| 4,676,920 | 6/1987 | Culshaw | 252/163 |
| 4,749,509 | 6/1988 | Kacher | 252/139 |
| 4,769,172 | 8/1988 | Siklosi | 252/153 |

FOREIGN PATENT DOCUMENTS

| | | |
|---|---|---|
| 0080749 | 6/1983 | European Pat. Off. . |
| 0126545 | 11/1984 | European Pat. Off. . |

*Primary Examiner*—Prince E. Willis
*Assistant Examiner*—A. Beadles-Hay
*Attorney, Agent, or Firm*—Robert B. Aylor; Richard C. Witte

[57] ABSTRACT

Liquid hard-surface cleaning compositions are disclosed which have a viscosity above 30 cps, show excellent cleaning on both kitchen and bathroom soils, and excellent shine performance.

These compositions are substantially free of hydrotropes, and contain a narrowly-defined binary solvent system constituted by Butyl Carbitol as one of the solvents and Butoxy Propoxy Propanol or Hexyl Carbitol as the other solvent.

8 Claims, No Drawings

VISCOUS HARD-SURFACE CLEANING COMPOSITIONS CONTAINING A BINARY GLYCOL ETHER SOLVENT SYSTEM

TECHNICAL FIELD

The present invention relates to liquid viscous hard-surface cleaning compositions containing a binary, glycol ether solvent system which have a viscosity above 30 cps, show excellent cleaning on both kitchen and bathroom soils, and excellent shine performance.

These compositions are substantially free of hydrotropes, and contain a narrowly-defined binary solvent system constituted of Butyl Carbitol as one of the solvents and butoxy propoxy propanol or Hexyl Carbitol as the other solvents.

BACKGROUND

It is well-known to formulate hard-surface cleaning compositions containing solvents.

In particular, compositions containing a binary solvent system constituted of terpenes and polar solvents such as benzyl alcohol and Butyl Carbitol have been disclosed in European Patent Nos. 0 040 882 and 0 080 749.

There is a need for hard-surface cleaners containing organic solvents, which are substantially free of hydrotropes, since hydrotropes such as cumene sulfonate can be deterimental to performance, especially shine.

There is also a need for liquid hard-surface cleaners which are more viscous than current similar products, i.e. which have a viscosity above 30 cps. Indeed, a product with such a viscosity, will show a better pouring control, will avoid product loss by penetration into e.g. the sponge used to apply it on the surface, and will be more efficient for use on inclined surfaces. Viscous products can be formulated using thickening agents typically used in commercial products. The rheology of such compositions is generally less desirable than that of the current invention. Thickening agents can also be detrimental to product performance.

It has now been found that liquid hard-surface cleaning compositions can be formulated, which are substantially free of hydrotrope, are substantially viscous and show remarkable cleaning efficiency on both kitchen and bathroom soils, and shine performance. Such compositions contain a specific binary solvent system.

EP-A No. 0 165 885 discloses concentrated liquid hard-surface cleaning compositions containing a ternary active system having hydrotroping properties. U.S. Pat. No. 3,591,510 relates to the use of propyleneglycol derivatives in dilute liquid hard-surface cleansers.

It is an object of the present invention to provide a liquid hard-surface cleaner composition with excellent cleaning on kitchen and bathroom soils and very good shine performance.

It is another object of the present invention to provide a liquid hard-surface cleaner which has a viscosity above 30 cps.

SUMMARY OF THE INVENTION

The present invention relates to a liquid hard-surface cleaning composition containing from 3% to 10% of surface-active agent from 3% to 10% of a binary solvent mixture consisting of Butyl Carbitol as one of the solvent, and n-butoxy propoxy propanol or Hexyl Carbitol as the other solvent, in a weight ratio of 4/1 to ¼;

from 1% to 10% of a builder and from 0.5% to 8% of a buffer, at a ratio of buffer to builder from 3/1 to ⅓ less than 1.5% of hydrotrope.

DETAILED DESCRIPTION OF THE INVENTION

The surface-active agents, the solvent and the optional ingredients are described in more detail hereinafter.

Unless indicated to the contrary, the %-indications stand for "% by weight".

SURFACE-ACTIVE AGENTS

Water-soluble detersive surfactants useful herein include well-known synthetic anionic, nonionic, amphoteric and zwitterionic surfactants and mixtures thereof. Typical of these are the alkyl benzene sulfates and sulfonates, paraffin sulfonates, olefin sulfonates, alkoxylated (especially ethoxylated) alcohols and alkyl phenols, amine oxides, sulfonates of fatty acids and of fatty acid esters, and the like, which are well-known in the detergency art. In general, such detersive surfactants contain an alkyl group in the $C_{10}$–$C_{18}$ range; the anionic detersive surfactants are most commonly used in the form of their sodium, potassium or triethanolammonium salts. The nonionics generally contain from 3 to 17 ethylene oxide groups per mole of hydrophobic moeity. Especially prreferred in the compositions of the present invention are: $C_{12}$–$C_{16}$ alkyl benzene sulfonates, $C_{12}$–$C_{18}$ paraffin-sulfonates and the ethoxylated alcohols of the formula $RO(CH_2CH_2O)_nH$, with R being a $C_{12}$–$C_{15}$ alkyl chain and n being a number from 3 to 10.

Anionic surfactants are frequently present at levels from 3 to 8% of the composition. Nonioic surfactants if used, are typically used at levels between 1% to 5% by weight of the composition. Mixtures of the like surfactants can also be used. The total level of surface-active agents in the present concentrated compositions is from 3% to 10% by weight of the total composition.

THE ORGANIC SOLVENT

The organic solvent for use herein is constituted by a very specific binary system of a water-soluble solvent and a solvent of low water-solubility.

The water-soluble solvent is Butyl Carbitol, i.e. 2-(2-butoxyethoxy)ethanol, and the water-insoluble solvent is selected from the group consisting of n-butoxy propoxy propanol, i.e. 1(2-n-butoxy-1-methylethoxy) propane-2-ol, and Hexyl Carbitol, i.e. 2-(2-hexoxyethoxy)ethanol. n-butoxy propoxy propanol is the preferred solvent of low water-solubility.

The weight ratio of Butyl Carbitol to n-butoxy propoxy propanol or Hexyl Carbitol is in the range from 4/1 to ¼, preferably from 4/1 to 1/1.

The total level of solvent is in the range from 3% to 10% of the total composition, preferably 4% to 8%.

BUILDER/BUFFER SYSTEM

Also critical in the context of the present invention is the Builder/Buffer system.

The Builder should be present at levels of from 1% to 10% preferably 1% to 5% by weight of the total composition.

Compounds classifiable and well-known in the art as detergent builders include the nitrilotriacetates, (NTA), polycarboxylates, citrates, water-soluble phosphates such as tri-polyphosphate and sodium ortho- and pyrophosphates, silicates, ethylene diamine tetraacetate (EDTA), amino-polyphosphonates (DEQUEST), phosphates and mixtures thereof. Preferred builder for use in the present invention is sodium citrate.

The Buffer is used to adjust and buffer the pH to a 8–11 range, preferably about 10–10.8. It is represented by alkali metal carbonates, preferably sodium carbonate; and present at levels of from 0.5% to 8%, preferably from 1% to 3% of the total composition. the ratio between buffer and builder should be in the range from 3/1 to ⅓, preferably 3/1 to 1/1.

PRODUCT VISCOSITY

The viscosity of the present compositions is above 30 cps, preferably in the range from 30 to 110 cps, which is substantially higher than current liquid compositions, 3 to 5 cps.

These figures apply to viscosity as measured in a Brookfield LVDT viscometer, with Spindle No. 2, at 60 rpm (low shear).

Optional components are represented by ingredients typically used in commercial products to provide aesthetic or additional product performance benefits. Typical ingredients include pH regulants, perfumes, dyes, optical brighteners, soil suspending agents, detersive enzymes, gel-control agents, freeze-thaw stabilizers, bactericides, preserrvatives, and the like.

There is no need for a thickener in the persent compositions.

Hydrotrope can be present, however at levels not exceeding 1.5%. Examples of suitable hydrotropes are urea, monoethanolamine, diethanolamine, triethanolamine and the sodium potassium, ammonium and alkanol ammonium salts of xylene-, toluene-, ethylbenzene- and isopropyl-benzene sulfonates.

The compositions herein typically contain water as a carrier. By way of example the water-level can vary in the range from e.g. 40% to 60%. Water-alcohol (e.g., ethanol, isopropanol, butanol, etc.) mixtures can also be used. Alkylated polysaccharides can be used to increase the stability and performance characteristics of the compositions.

The following examples are given by way of illustrating the compositions herein, but are not intended to be limiting of the scope of the invention.

ABBREVIATIONS

LAS: Sosium Salt of Linear $C_{11-18}$ Alkyl Benzene Sulfonate

NAPS: Sodium $C_{13}$–$C_{16}$ paraffin sulfonate

NTA: Sodium nitrilotriacetate n-BPP: n-butoxy propoxy propanol.

The following compositions are prepared:

| Ingredient | percentage by weight | | | | | |
|---|---|---|---|---|---|---|
| LAS | 5 | 5 | 4 | 4 | 5 | — |
| NaPS | — | — | 2 | 1 | — | — |
| Lauryl alcohol sulphate | — | — | — | — | — | 5 |
| Sodium Carbonate | 3 | 3 | 3 | 2 | 4 | 3 |
| Sodium Citrate | 1 | 3 | 1 | — | 2 | 1 |
| NTA | — | — | — | 2 | — | — |
| Butyl Carbitol | 4 | 4 | 4 | 3 | 3 | 4 |
| n-BPP | 2 | 2 | — | 3 | 3 | 2 |
| Hexyl Carbitol | — | — | 2 | — | — | — |
| Perfume | 0.5 | 1.0 | 1.0 | 0.5 | 0.5 | 0.5 |
| Dyes, miscellaneous, water | | | up to 100 | | | |
| Product viscosity (cps) | 90 | 100 | 70 | 70 | 110 | 50 |

The above compositions were found to show very good cleaning performance on both kitchen and bathroom soils, and excellent shine performance.

We claim:

1. A vicous liquid hard-surface cleaning composition having a viscosity of more than about 30 cps containing:

A. from 3% to 10% of surface-active agent;

B. from 3% to 10% of a binary solvent mixture consisting of:

(1) Butyl Carbitol and (2) n-butoxy propoxy propanol, the weight ratio of (1) to (2) being from 3/1 to ⅓;

C. from 1% to 10% of builder;

D. from 0.5% to 8% of buffer, the weight ratio of C to D being from ⅓ to 3/1;

E. less than 1.5% of hydrotrope; and

F. the balance water.

2. The composition of claim 1 wherein the weight ratio of B(1) to B(2) is from 4/1 to 1/1.

3. The composition of claim 1 wherein the builder is sodium citrate, the buffer is sodium carbonate, and the weight ratio of C to D is from ⅓ to 1/1.

4. The composition of claim 1 wherein there is from 4% to 8% of said binary solvent mixture.

5. The composition of claim 4, wherein said builder is at a level of from 1% to 5%, said buffer is at a level of from 1% to 3%, there is essentially no thickener present, and the viscosity is between 30 and 110 cps.

6. The composition of claim 5 wherein the pH of the composition is from 10 to 10.8.

7. The composition of claim 1 wherein A is detersive surfactant containing a $C_{10-18}$ group.

8. The composition of claim 1 which does not contain an effective amount of thickener.

* * * * *

UNITED STATES PATENT AND TRADEMARK OFFICE

CERTIFICATE OF CORRECTION

PATENT NO. : 4,966,724

DATED : October 30, 1990

INVENTOR(S) : Stephen Culshaw and Eddy Vos

It is certified that error appears in the above-identified patent and that said Letters Patent is hereby corrected as shown below:

Col. 1, line 15, "butoxy propoxy propanol" should read -- Butoxy Propoxy Propanol --.

Col. 1, line 16, "solvents" should read -- solvent --.

Col. 1, line 69, "solvent" should read -- solvents --.

Col. 1, line 69, "n-butoxy" should read -- n-Butoxy --.

Col. 2, line 1, "propoxy propanol" should read -- Propoxy Propanol --.

Col. 2, line 2, "$\frac{1}{4}$" should read -- 1/4 --.

Col. 2, line 4, "$\frac{1}{3}$" should read -- 1/3 --.

Col. 2, line 30, "prreferred" should read -- preferred --.

Col. 2, lines 49-50, "n-butoxy propoxy propanol" should read -- n-Butoxy Propoxy Propanol --.

Col. 2, line 52, "n-butoxy propoxy propanol" should read -- n-Butoxy Propoxy Propanol --.

Col. 2, lines 54-55, "n-butoxy propoxy propanol" should read -- n-Butoxy Propoxy Propanol --.

UNITED STATES PATENT AND TRADEMARK OFFICE

CERTIFICATE OF CORRECTION

PATENT NO. : 4,966,724

DATED : October 30, 1990

INVENTOR(S) : Stephen Culshaw and Eddy Vos

It is certified that error appears in the above-identified patent and that said Letters Patent is hereby corrected as shown below:

Col. 2, line 56, "$\frac{1}{4}$" should read -- 1/4 --.

Col. 3, line 12, "$\frac{1}{3}$" should read -- 1/3 --.

Col. 3, line 28, "preserrvatives" should read -- preservatives --.

Col. 3, line 50, "Sosium" should read -- Sodium --.

Col. 4, line 2, "n-butoxy propoxy propanol" should read -- n-Butoxy Propoxy Propanol --.

Col. 4, line 29, "$\frac{1}{3}$" should read -- 1/3 --.

Col. 4, line 32, "$\frac{1}{3}$" should read -- 1/3 --.

Col. 4, line 39, "$\frac{1}{3}$" should read -- 1/3 --.

Signed and Sealed this

Eighth Day of September, 1992

*Attest:*

DOUGLAS B. COMER

*Attesting Officer*

*Acting Commissioner of Patents and Trademarks*